US005842609A

United States Patent [19]

Higgins et al.

[11] Patent Number: 5,842,609

[45] Date of Patent: Dec. 1, 1998

[54] PERSONAL HYGIENE LIQUIDS DISPENSER

[75] Inventors: Bruce Wayne Higgins, South Lyon; Amos Gil, Farmington Hills, both of Mich.

[73] Assignee: Brass-Craft Manufacturing Company, Farmington Hills, Mich.

[21] Appl. No.: 672,820

[22] Filed: Jun. 28, 1996

[51] Int. Cl.[6] ..... B67D 5/06

[52] U.S. Cl. ..... 222/181.3; 222/383.1; 137/513.5

[58] Field of Search ..... 222/181.2, 181.3, 222/182, 185, 154, 132, 383.1, 341; 137/513.5

[56] References Cited

U.S. PATENT DOCUMENTS

| | | | |
|---|---|---|---|
| Re. 6,464 | 6/1875 | Hopkins . | |
| D. 324,619 | 3/1992 | Comstock et al. . | |
| 591,228 | 10/1897 | Goltermann . | |
| 711,846 | 10/1902 | Gossard . | |
| 1,553,113 | 9/1925 | Rutt . | |
| 2,464,030 | 3/1949 | Engstrom . | |
| 2,529,365 | 11/1950 | Barksdale . | |
| 3,148,700 | 9/1964 | Friedell . | |
| 3,164,302 | 1/1965 | Indjian . | |
| 3,168,353 | 2/1965 | Horowitz . | |
| 3,190,284 | 6/1965 | Koepf | 137/513.5 |
| 3,231,236 | 1/1966 | Hodel et al. . | |
| 3,487,853 | 1/1970 | Kern, Jr. . | |
| 3,720,352 | 3/1973 | Kozlowski . | |
| 3,730,224 | 5/1973 | Prisk . | |
| 3,841,349 | 10/1974 | Todd | 137/513.5 |
| 3,920,160 | 11/1975 | Casale et al. . | |
| 4,949,877 | 8/1990 | Hanna et al. . | |
| 5,183,182 | 2/1993 | Comstock et al. . | |

FOREIGN PATENT DOCUMENTS

| | | | |
|---|---|---|---|
| 656296 | 10/1947 | United Kingdom | 251/321 |

*Primary Examiner*—Philippe Derakshani
*Attorney, Agent, or Firm*—Reising, Ethington, Barnard & Perry

[57] ABSTRACT

A liquid dispensing device (10) for personal hygiene liquids is wall mounted with a plurality of containers (14) and valves (16). Each valve includes a valve plunger (60) with a head (62) having a flexible periphery (64) that provides increased bypass of liquid upon harder pressing and faster motion of the plunger. The valve has a seat (74) that presses the flexible periphery (64) against the valve inner cylindrical wall (54) of the valve bore (52) at the end of the return stroke. Each valve is also provided with a check valve (90) in an inlet port of the valve to restrict fluid flow back into the container upon actuation of the plunger. Each check valve is provided with a notch (100) that allows some restricted fluid flow of liquid back into the supply container (14) upon excessive pressure with in the valve bore (52).

10 Claims, 5 Drawing Sheets

PERSONAL HYGIENE LIQUIDS DISPENSER

TECHNICAL FIELD

The field of this invention relates to a fluid dispenser for use with liquid soap, shampoo, conditioner and other personal hygiene liquids.

BACKGROUND OF THE DISCLOSURE

The convenience of liquid personal hygiene products, such as soap, shampoo, hair tonic, skin cream, hair conditioner, and baby oil is known and many types of dispensers have been developed to accommodate these personal hygiene liquids. While these personal hygiene liquids are often used with simple gravity fed valve dispensers, the viscosity of many of these products prevents a satisfactorily adequate flow from the container. As a consequence, plunger type pumps which forcefully discharge the liquid under pressure have been developed.

A common set up for these plungers is to have the supply container on top, the plunger and delivery cylinder horizontally disposed and situated below the container, and a downward facing outlet nozzle. The outlet nozzle is often axially displaced forwardly from the inlet connected to the container to provide a more convenient location for the discharge of the liquid. This setup is particularly useful where the dispenser is mounted on a wall and the push button of the plunger faces the user so that the discharge outlet is spaced a sufficient distance from the wall to allow a person's hand to be situated fully under the discharge nozzle.

A multi-unit that includes several containers and valves removably positioned on a wall mounted shell is known. U.S. Pat. No. 5,183,182 discloses one with a closable and lockable cover that allows the containers to be removed for refilling.

Previous constructions of plunger dispensers have a separate seal element that seals off the supply of liquid in the container from the nozzle when the plunger is not in use. However, the plunger can create excessively high pressures when it is pushed sufficiently hard, particularly when more viscous fluids are being pumped. The plunger is often pushed with great force when a person needs a great amount of the liquid or is otherwise impatient. The operator will often push the plunger as fast as it can go and repeat the process as fast as possible. The resulting excessive pressure can blow the seals from their intended position and create leakage of the valve or blow the needed check valve that is interposed between the supply container and the cylinder which renders the dispenser inoperable.

What is needed is a durable plunger driven liquid dispenser that has a mechanism that prevents excessive pressure within the cylinder while using the plunger periphery to seal the nozzle against leakage when not in use.

SUMMARY OF THE DISCLOSURE

In accordance with one aspect of the invention, a liquid dispenser valve includes a housing having an inlet port connectable to a supply container, a cylinder sized to receive a plunger head, and a discharge nozzle axially forwardly positioned in the cylinder. A check valve is mounted in the inlet port to restrict the flow of liquid upstream out of the inlet port. A plunger is mounted for forward and rearward axial movement in the cylinder. A return spring is interposed between the plunger and a closed axial end of the cylinder for resiliently biasing and moving the plunger forwardly for a return stroke to a first axial position between the inlet port and the discharge outlet and to allow a stroking motion to a rearward second axial position toward the inlet port.

In one embodiment, the plunger has a head with a flexible periphery that when resting in the first axial position abuts against the cylinder wall to form a seal against leakage of liquid from the container to the discharge nozzle. When the plunger is moved rearwardly to the second position, the periphery is flexed inwardly to allow liquid to flow by the plunger head and flow from the inlet port to the discharge spout. The plunger has a plunger rod connected to the head that extends out of a front end of the cylinder and attached to a push button for manual operation of the plunger.

A closure cap is removably connected to a front end of the housing and about the plunger rod. The closure cap has seals interposed between itself, the cylinder wall, and the plunger rod. A seat is mounted in the cylinder for abutting an inner wall of the periphery of the plunger head when the plunger head is in the first axial position to bias the flexible periphery outwardly to abut the cylinder wall and form a seal within the cylinder to prevent fluid from passing to the discharge nozzle when the plunger rests in the first axial position. Preferably, the seat is in the shape of prongs that have an arcuate tapered end to conform the shape of the outer periphery of the plunger head to the shape of the inner wall of the cylinder seal against the inner wall of the cylinder. Desirably, the prongs are affixed to or formed as part of the closure cap.

In accordance with another aspect of the invention, the check valve in the inlet has a bypass port that remains continuously open to prevent complete closure of the check valve to reduce pressure build up within the cylinder during movement of the plunger toward the second axial position. In one embodiment, the bypass port is in the form of a notch in a seat that seats a ball check valve.

In this dispenser, an expeditiously constructed valve provides for adequate sealing when not in use and provides for durability by reducing any excess pressure that may otherwise damage the check valve or seals.

BRIEF DESCRIPTION OF THE DRAWINGS

Reference now is made to the accompanying drawings in which.

DETAILED DESCRIPTION OF THE PREFERRED EMBODIMENT

Figure 1:
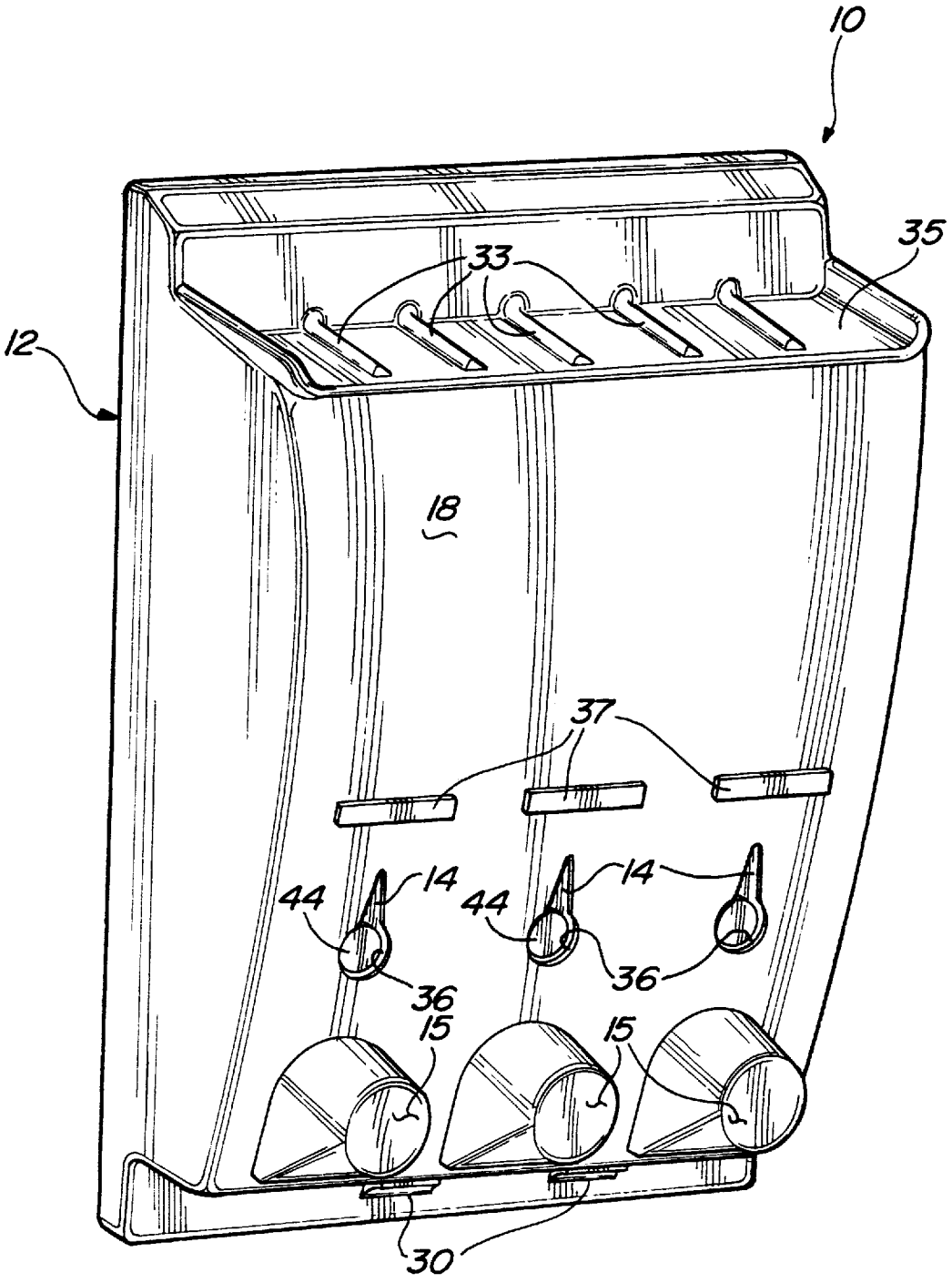
FIG. 1 is a front perspective view of a liquid dispenser assembly having multiple containers and dispenser valves installed in a wall mounted housing.
Figure 2:
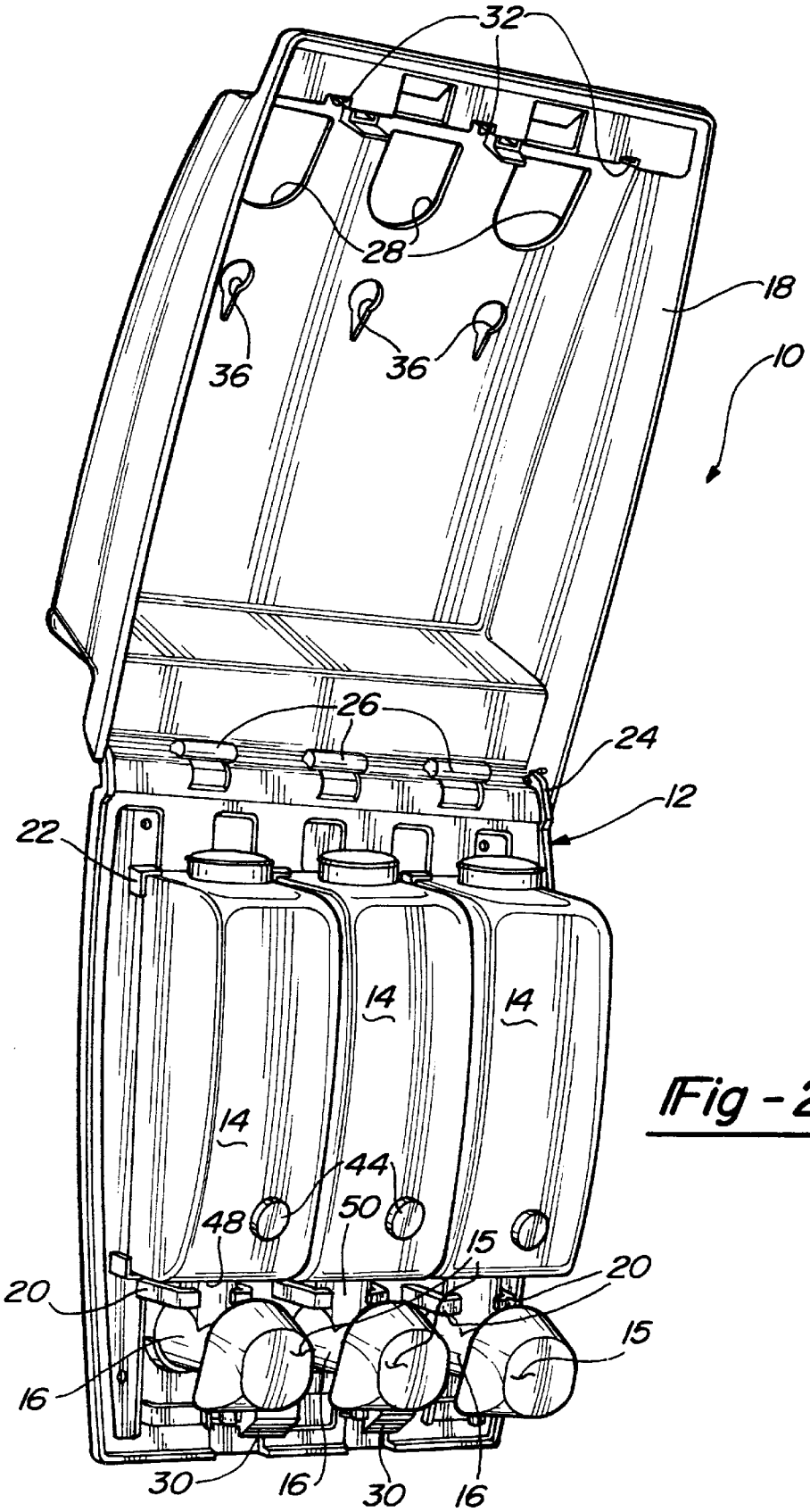
FIG. 2 is a view similar to FIG. 1 illustrating the housing cover in the open position to access the individual containers.

Referring now to FIGS. 1 and 2, a liquid dispenser assembly 10 for personal hygiene liquids can be mounted on a wall in a shower, bath or sink area. The dispenser 10 includes a wall mounted housing 12 that stores a plurality of containers 14, each connected to a dispenser valve 16 operated by push button 15. A cover 18 is pivotably connected to the housing 12 to move from the normal closed position shown in FIG. 1 to the open position to allow removal, refilling and repairing or replacement of the containers 14 and valves 16.

Each container and valve 16 can be mounted onto the housing 12 via appropriately shaped snap fit prongs 20, and support brackets 22 as clearly shown in FIG. 2. The cover 18 can be retained in the open raised position by a conventional lock latch 24 about a conventional concealed hinge connection 26 at the upper edge of the cover 18 and housing 12. The cover also has access holes 28 that allow operation of push buttons 15 as described later. The cover also has exit openings 32 aligned under discharge spout 34 of the valve 16 for allowing the liquid to pass therethrough. Furthermore, the cover has openings 36 above the push buttons 15 so that the liquid level can be seen for a transparent container 14 to provide an indicator when refilling is needed. As clearly shown in FIG. 1, the top of cover 18 may be shaped to form a useful storage shelf 35 or bar soap holder with appropriate raised ridges 33 and the side may be provided with labelling areas 37. The cover 18 may be retained in the closed position by releasable snap fit latches 30.

Figure 3:
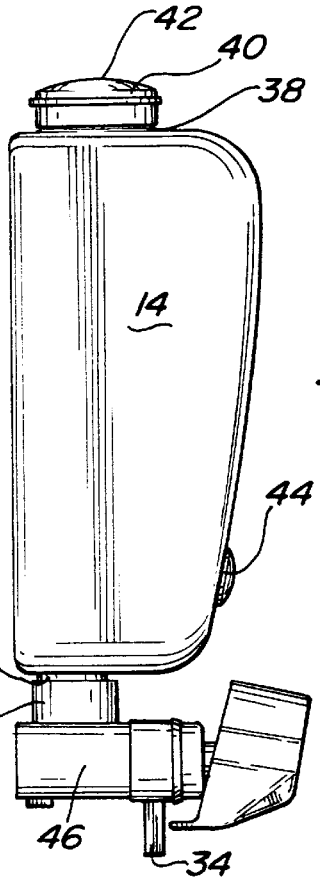
FIG. 3 is a side elevational view illustrating one of the containers and dispenser valves shown in FIG. 2.

Referring now to FIGS. 2 and 3, each container 14 is preferably made from a transparent plastic to allow for the openings 36 to function as a refill indicator. The top has a refill aperture 38 that snap fits a plastic cap 40 that has a small air aperture 42 therethrough. The container 14 also has a small embossed side window 44 that is aligned with opening 36 to provide better visibility of the interior of container 14 and the level of liquid therein. The bottom of the container has an outlet neck portion 48 that is adhered to a inlet port 50 of valve body 46. Such adherence may be formed by an adhesive glue.

Figure 4:
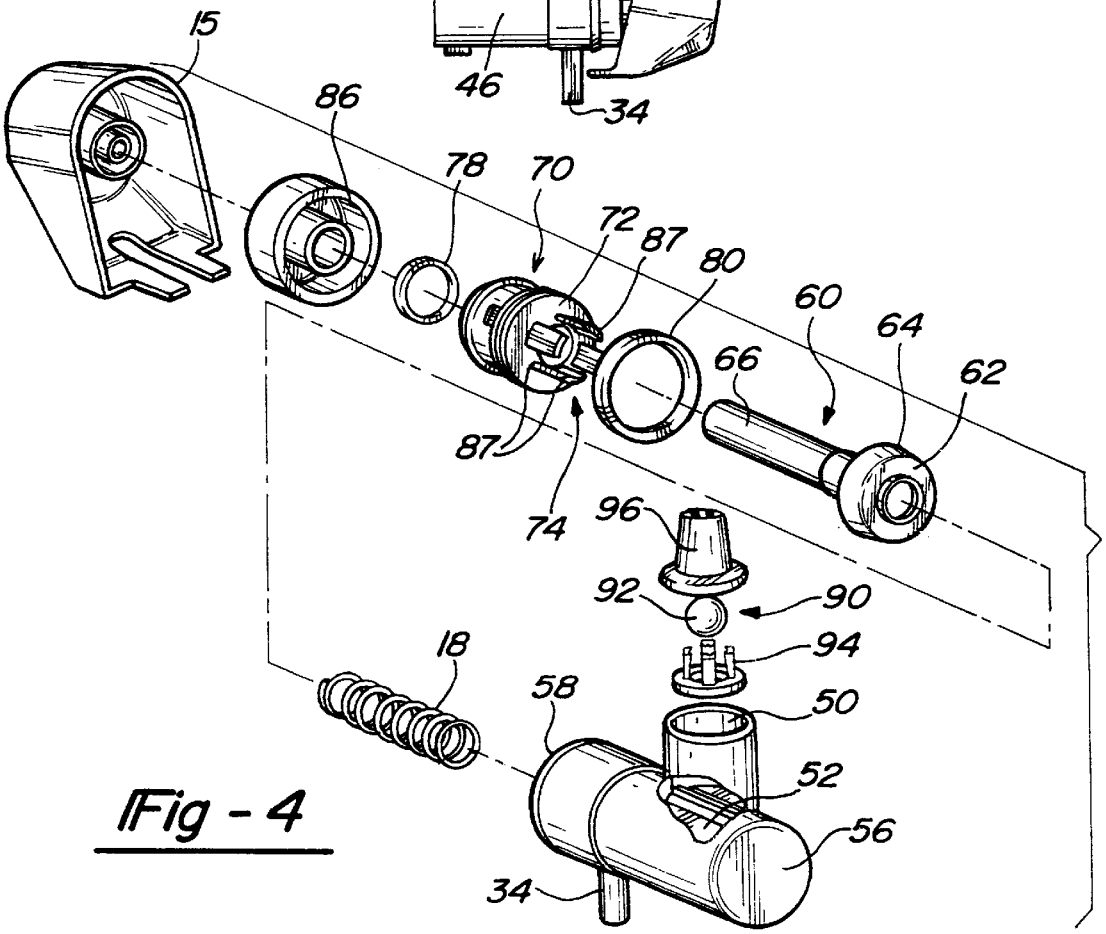
FIG. 4 is an exploded rear perspective view of the dispenser valve shown in FIG. 3.
Figure 5:
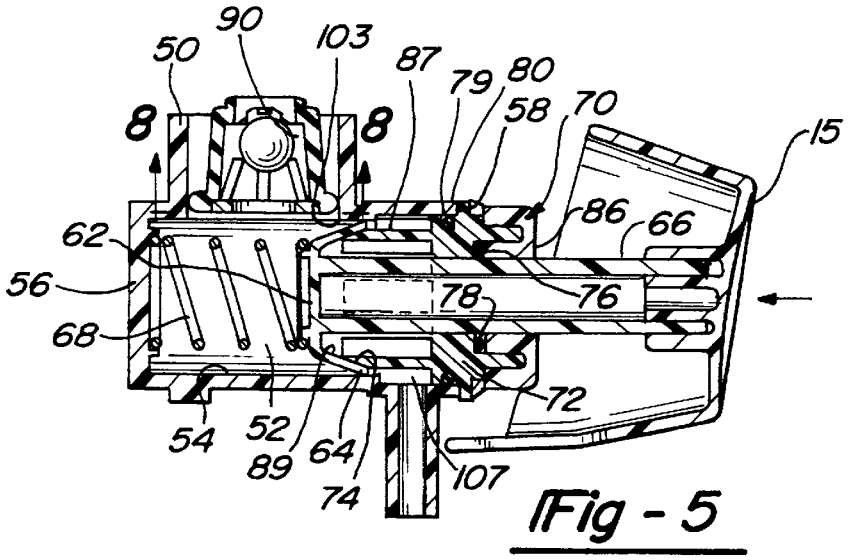
FIG. 5 is a side elevational and segmented view of the dispenser valve shown in FIG. 3 with the valve in the rest or unused position.

As shown in FIGS. 3, 4 and 5, the valve body 46 has the inlet port 50 axially spaced from the discharge spout 34. The port 50 and spout 34 are connected via a cylindrical bore 52 with a inner wall 54. The bore has a closed rear end 56 and an open front end 58.

A plunger 60 has a head 62 with a flexible periphery 64 connected to a plunger rod 66. The flexible head 62 is sized to have its periphery 64, when in a rest position to abut the cylindrical wall 56 as shown in FIG. 5. A return spring 68 is interposed between the head 62 and the closed end 56. A cap assembly 70 has a spacer member 72 that both provides a stop 74 for the plunger as illustrated in FIGS. 4 and 5 and seals the open outer end 58 of valve and allows the rod 66 to extend out of the valve body 46. The spacer member has an internal seat 76 that seats o-ring 78 for sealing the spacer member with the rod 66. The spacer member also has an external groove 79 that seats external o-ring 80 that seals the spacer with the wall 54. As labeled in FIG. 6, the spacer may also have tabs 82 outboard of the o-ring groove 79 that snap fit into apertures 84 that the retain the cap assembly 70 in place against normal forces encountered from actuation of the rod 66 and bias from the return spring 68. The cap assembly 70 may also be provided with an outer cover 86 affixed to the spacer member 72 to retain the internal o-ring 80 in place. Operating button 15 is attached to the front end of rod 66.

The stop 74 includes has four arcuate protrusions 87 with tapered or canted rear surfaces 88 that abut an inner surface 89 of the outer periphery 64. The arcuate shape of the protrusion surfaces 88 conform to the inner cylindrical wall 54 to push the flexible periphery against the wall 54 to form a seal against the wall 54 when the periphery is in the rest position shown in FIG. 5.

Figure 6:
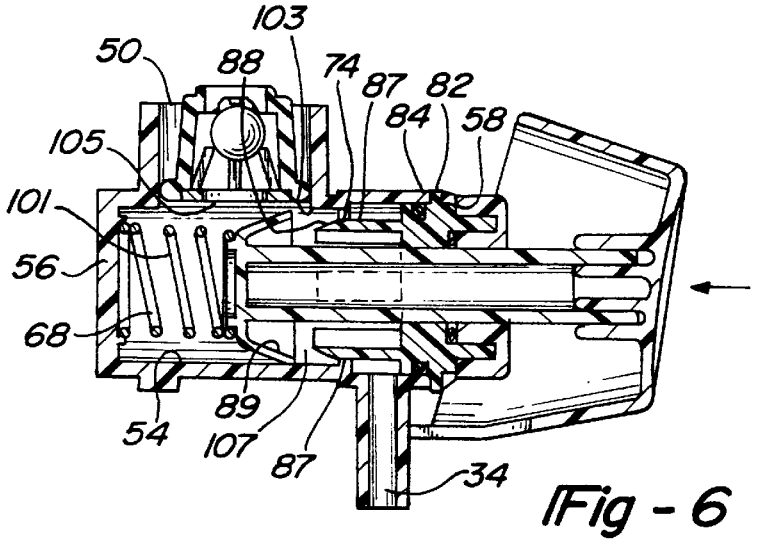
FIG. 6 is a view similar to FIG. 5 with the dispenser valve shown in the intermediate position during an actuation stroke.
Figure 7:
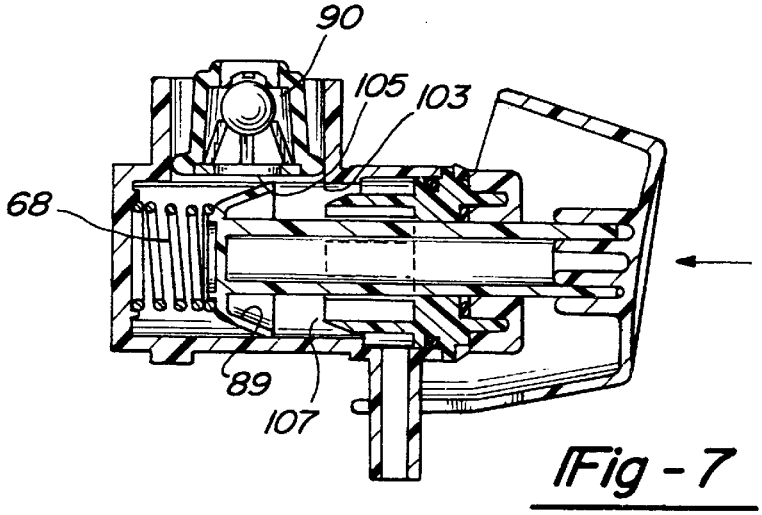
FIG. 7 is a view similar to FIG. 6 with the dispenser valve shown in the fully pressed position.
Figure 8:
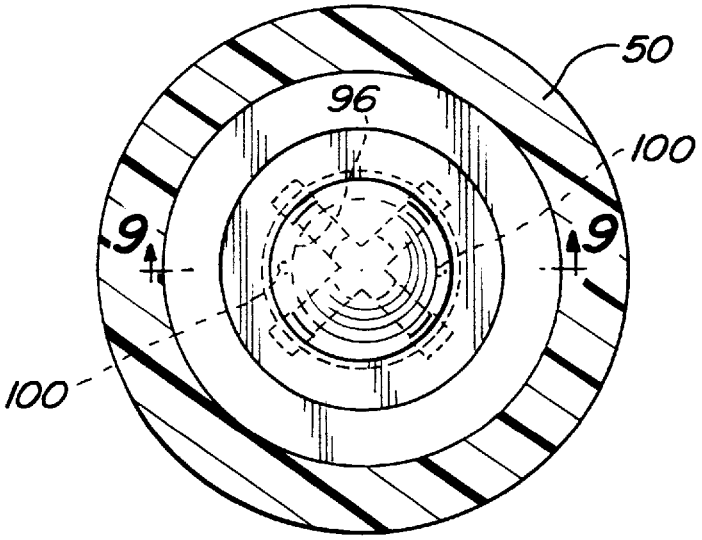
FIG. 8 is a cross-sectional view taken along lines 8—8 shown in FIG. 5.
Figure 9:
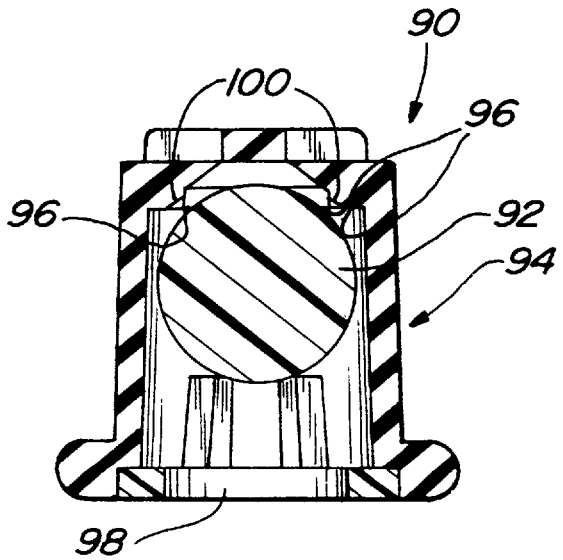
FIG. 9 is a cross-sectional view taken along lines 9—9 shown in FIG. 8.

A check valve 90 is mounted in the inlet port 50 for restricting flow from the valve body 46 back to container 14. The check valve has a ball element 92 seated in a cage 94. The ball is normally in the position shown in FIG. 9 with the ball 90 in the open position that allows relatively unrestricted flow through the cage from seat 96 through lower outlet 98 and into valve body 46. The seat 96 has two notches 100 therein that prevents the ball from completely sealing against seat 96 when in the closed higher position as shown in FIGS. 6 and 7.

Initially when the button 15 is at rest, the spring 68 pushes the rod 66 forwardly to the position shown in FIG. 5 to force the flexible periphery 64 against the canted protrusions 87 to form a seal against the inner cylindrical wall 54 and close off communication between the container and the discharge spout.

Operation of the dispenser is extremely convenient. The operator merely pushes button 15 when liquid is desired from discharge spout 34. Upon pressing the button shown in the FIGS. 6 and 7, the rise in pressure within the bore 52 forces the ball 92 upward against seat 96. Further pressing of the button, moves the plunger into the bore 52 which causes liquid in the rear section 101 of the bore 52 to flow by the head 62 toward and out through discharge spout 34. The flexible periphery flexes radially inwardly to accommodate the passage of liquid by the plunger head 62. When the plunger head is pressed past the forward end 103 of inlet port 50, the liquid can also pass by the top end of outer periphery along section 105 to be discharged through the spout 34.

The notches 100 in the check valve 90 provide for some restricted flow of the liquid under pressure in the bore 52 to flow back into the container when the plunger is pressed with an excessive amount of pressure. The restricted flow out of the bore 52 back into the container 14 alleviates excessive pressure within section that may otherwise blow the check valve ball 92 out of the cage 94 and past the seat 96.

Upon release of the button 15, the spring 68 pushes the plunger 62 forward thereby increasing the size of the rear section 101 of the bore 52 and the ball drops to open the inlet port and allowing liquid from the container to refill the bore 52. The small air aperture 42 in the cap 40 of container 14 prevents a vacuum buildup within the container to maintain adequate liquid flow into the valve 16 from container 14 upon the return stroke of the plunger. The spring returns the plunger to the position shown in FIG. 5 and allows for immediate repeated actuation of the button 15.

The return stroke of the plunger head 62 also provides a wiping action of the inner cylindrical boer 52 by the flexible periphery 64 of head 62. The wiping prevents any viscous fluid to remain in the bore 52 clinging to the wall and congealing thereon which would otherwise eventually render the valve mechanism useless. Furthermore, the wiping action provides that the liquid or fluid within the front section 107 of the bore 52 in front of the head 62 is pushed out through the discharge spout 34 during the return stroke.

The combination of the flexible outer periphery 64 and the notches 100 virtually eliminate the possibility of excessive pressure being built up within the valve body. The faster the plunger is pushed, the more the outer periphery flexes, thereby allowing a greater bypass flow from section 101 and out to the discharge spout. The notches 100 also provide flow back up to the container when the pressure within section 101 becomes high.

In this fashion, a more durable and long lasting dispenser that is capable of punishing usage and provides leak free sealing of the liquid within the container and proper and easy dispensing of the liquid when desired is accomplished in an expeditiously constructed, easily operated and easily maintained assembly.

Variations and modifications are possible without departing from the scope and spirit of the present invention as defined by the appended claims.

The embodiments in which an exclusive property or privilege is claimed are defined as follows:

1. A liquid dispenser valve characterized by:

a housing having an inlet connectable to a supply container, a cylinder sized to receive a plunger head and a discharge nozzle axially positioned along a forward position in said cylinder;

a check valve mounted in said inlet to restrict the flow of liquid upstream out of said inlet;

a plunger mounted for axial movement in said cylinder;

a return spring interposed between the plunger and a closed axial end of said cylinder for resiliently biasing and moving said plunger forwardly for a return stroke to a first axial position between said inlet and said discharge outlet and to allow a stroking motion to a rearward second axial position toward said inlet;

said plunger having a head with a flexible periphery with an inner wall and outer wall, the flexible periphery when in the first axial position has its outer wall abuts against the cylinder wall to form a seal against leakage of liquid from said container to said discharge nozzle and when moved rearwardly to said second position flexed inwardly to allow liquid to flow by said piston head from said inlet to said discharge spout;

said plunger having a plunger rod connected to said head that extends out of a front end of said cylinder and attached to a push button for manual operation of said plunger;

a closure cap removably connected to a front end of said housing and about said plunger rod and having seals interposed between itself and said cylinder wall and said plunger rod;

a seat for said inner wall of said periphery for abutting said inner wall of the periphery of said plunger head when said plunger head is in said first axial position to bias said periphery outwardly to abut said cylinder wall and form a seal within said cylinder to prevent fluid from passing to said discharge nozzle when said plunger rests in said first axial position.

2. A liquid dispenser valve as defined in claim 1 further characterized by:

said seat includes a plurality of prongs having an arcuate tapered outer shape to conform the shape of the periphery to shape of the inner wall of said cylinder to seal the periphery against said inner wall of said cylinder.

3. A liquid dispenser valve as defined in claim 2 further characterized by:

said prongs being affixed to said closure cap.

4. A liquid dispenser valve as defined in claim 1 further characterized by:

said seat being affixed to said closure cap and having an arcuate and tapered rear end to conform the shape of the periphery to shape of the inner wall of said cylinder to seal the periphery against said inner wall of said cylinder.

5. A liquid dispenser valve as defined in claim 2 further characterized by:

said check valve in said inlet having a bypass port that remains continuously open to prevent complete closure of said check valve to reduce pressure build up within said cylinder during movement of said plunger toward said second axial position.

6. A liquid dispenser valve as defined in claim 5 further characterized by:

said bypass port being a notch in a seat that seats a ball check valve.

7. A liquid dispenser valve as defined in claim 1 further characterized by:

said flexible periphery angled to abut the inner side wall of said cylinder during the return stroke to the first axial position under the force of the return spring.

8. A liquid dispenser valve as defined in claim 1 further characterized by:

said closure cap having a radial inner groove for mounting an internal o-ring that abuts against the plunger rod and a radial outer groove for mounting a second o-ring that abuts against the inner cylinder wall.

9. A liquid dispenser valve characterized by:

a housing having an inlet connectable to a supply container, a cylinder sized to receive a plunger head and a discharge nozzle axially displaced from said inlet;

a plunger mounted for axial movement in said cylinder;

a return spring interposed between the plunger and a closed axial end of said cylinder for resiliently biasing and moving said plunger forwardly for a return stroke to a first axial position between said inlet and said discharge outlet and to allow a stroking motion to a rearward second axial position toward said inlet;

said plunger having a plunger rod connected to said head that extends out of a front end of said cylinder and attached to a push button for manual operation of said plunger;

a closure cap removably connected to a front end of said housing and about said plunger rod and having seals interposed between itself and said cylinder wall and said plunger rod;

a check valve mounted in said inlet, said check valve constructed to allow flow through said inlet and into said housing and to allow reverse restrictive flow of liquid upstream out of said inlet from said housing by having a bypass port that remains continuously open to prevent complete closure of said check valve to reduce pressure build up within said cylinder during movement of said plunger toward said second axial position.

10. A liquid dispenser valve as defined in claim 9 further characterized by:

said bypass port being a notch in a seat that seats a ball check valve.

* * * * *